United States Patent [19]

Heikkinen

[11] Patent Number: 4,756,388

[45] Date of Patent: Jul. 12, 1988

[54] ELEVATOR WITH TRACTION SHEAVE

[75] Inventor: Urho Heikkinen, Espoo, Finland

[73] Assignee: Kone Elevator GmbH, Baar, Switzerland

[21] Appl. No.: 26,001

[22] Filed: Mar. 16, 1987

[30] Foreign Application Priority Data

May 29, 1986 [FI] Finland ..... 862293

[51] Int. Cl.[4] ..... B66B 11/04

[52] U.S. Cl. ..... 187/20; 254/264

[58] Field of Search ..... 187/20, 22, 27; 254/264, 371; 74/89.22, 89.2, 505, 506

[56] References Cited

U.S. PATENT DOCUMENTS 4,591,025 5/1986 Honda ..... 187/20

FOREIGN PATENT DOCUMENTS 197042 4/1908 Fed. Rep. of Germany ..... 187/20
311222 10/1917 Fed. Rep. of Germany .
351821 4/1919 Fed. Rep. of Germany .
2312449 1/1977 France ..... 187/20
18160 2/1978 Japan ..... 187/20
2148229 10/1984 United Kingdom ..... 187/20

*Primary Examiner*—H. Grant Skaggs
*Assistant Examiner*—Kenneth Noland
*Attorney, Agent, or Firm*—Sughrue, Mion, Zinn, Macpeak and Seas

[57] ABSTRACT

An elevator has a drive mechanism connected to a traction sheave provided with grooves, over which run parallel suspension cables, and an elevator cage and an associated counterweight suspended from the suspension cables. The elevator is also provided with at least two diverting pulleys over which the suspension cables run and of which at least one diverting pulley is associated with the traction sheave in such manner that the suspension cables extending from the elevator cage to the counterweight have first and second wraps around the traction sheave and, between these wraps, a further wrap around the diverting pulley. Prior art traction sheave elevators exhibit insufficient friction between the traction sheave and the suspension cable, for which reason it is necessary, in the case of elevators of great heights, to use so-called compensating cables, which add to the weight of the elevator. With the present invention, this disadvantage is avoided by giving each of the first and second wraps an angle of wrap of at least 180°.

5 Claims, 2 Drawing Sheets

ELEVATOR WITH TRACTION SHEAVE

FIELD OF THE INVENTION

The present invention relates to a traction sheave elevator comprising a drive mechanism, a traction sheave connected thereto and provided with cable grooves and parallel suspension cables running around the traction sheave, with an elevator cage suspended from the suspension cables and a counterweight therefor, the traction sheave elevator being provided, in addition to the traction sheave, with at least two diverting pulleys over which the suspension cables run and at least one of these diverting pulleys being associated with the traction sheave in such manner that the cables extending from the elevator cage to the counterweight have two wraps around the traction sheave and, between these two wraps, are wrapped one around that diverting pulley.

DESCRIPTION OF THE PRIOR ART

A suspension system similar to this has been disclosed in Finnish Pat. No. 56,813, which discloses a so-called "ESW suspension" in which, in practice, the maximum angle of contact between the traction sheave and the cable running around it is 252°. In more complex "double wrap" elevators, the angle of contact or wrap of the cable can be made 300° to 310°, and the cable usually runs in a semicircular groove.

Elevators of this type have a high annular usage (about 400,000 to 800,000 starts), for which reason cable grooves which help to support the cables are used in order to save the cables. A semicircular groove, for instance, is one such cable groove and has no undercutting. The friction grip is, however, reduced when such grooves are used, with the consequence that the masses of the cage and the counterweight have to be increased. From this it follows, further, that the diameter of the cables must also be increased, whereby their weight increases. A thicker cable also requires a larger traction sheave diameter, whereby a higher driving torque becomes necessary. Such elevators are normally employed when the velocities and elevating heights are great, in which case high accelerations are also employed in order to reduce the time intervals between floors. However, high accelerations imply high friction grippage and, owing to low friction, one is compelled, even for fairly small elevating heights, to use so-called compensating cables, which add to the linear mass of the elevator. A motor with even higher torque, and therefore commanding a higher price, is then required.

BRIEF SUMMARY OF THE INVENTION

It is accordingly an object of the present invention to achieve an improvement in a traction sheave elevator provided with a normal double wrap suspension.

It is a further object of the present invention to provide a novel and improved traction sheave elevator which overcomes the above-discussed disadvantages of prior art elevators.

The present invention provides a traction sheave elevator comprising an elevator cage, a counterweight for counterweighting the elevator cage and suspension cables extending between the counterweight and the elevator cage for suspending the elevator cage. A traction sheave drivingly engages the suspension cables, and has groove for receiving the suspension cables. The traction sheave is driven to thereby displace the elevator cage, at least two diverting pulleys being associated with the traction sheave for deflecting the suspension cables. The suspension cables have first and second wraps around the traction sheave and are wrapped, between the first and second wraps, about one of the diverting pulleys, the angles of wrap of each of the first and second wraps being greater than 180°.

Preferably, the first and second wraps have a total angle of wrap about the tractor sheave means of 400° to 540°.

In an advantageous embodiment of the invention, the suspension cables are intercalated at locations where they cross themselves. For this purpose, the traction sheave is preferably inclined towards the diverting pulley and the latter is inclined about an axis passing through the centre of the sheave and the pulley.

By means of the design of the present invention, a lower elevator cage weight than heretofore is achieved. Greater suspension heights than heretofore, without compensating cables, also become possible. The greatest savings are achieved with a so-called gearless elevator, which can be built without compensating cables for suspension heights up to about 60 m. Moreover, higher accelerations can be used in a elevator according to the invention. Likewise, thinner cables can be used and thereby the diameter of the traction sheave can also be reduced. As a result, the torque on the shaft of the gearless motor will be less and it also becomes possible to use a smaller motor.

BRIEF DESCRIPTION OF THE DRAWINGS

An embodiment of the invention is described in greater detail in the following, with reference to the attached drawing, wherein.

DESCRIPTION OF THE PREFERRED EMBODIMENT

Figure 1:
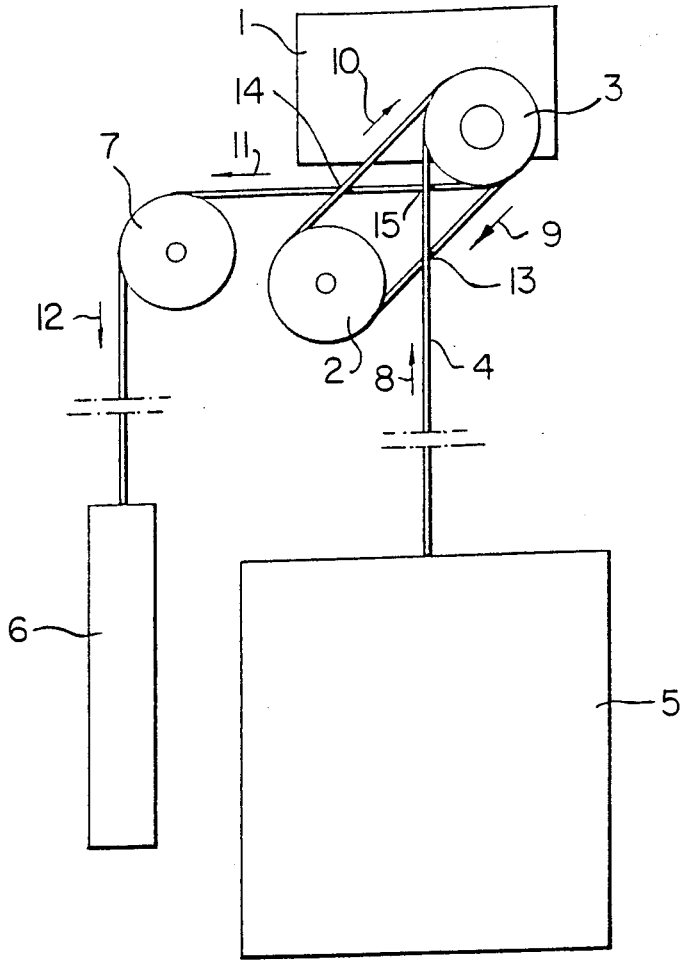
FIG. 1 presents a traction sheave elevator embodying the invention, in elevational view.

In FIG. 1 there is illustrated a elevator cage or car 5 disposed in guides (not shown) provided in a elevator shaft (not shown), this cage being suspended by parallel suspension cables 4, of which only one can be seen in FIG. 1.

The drive mechanism 1 of the elevator is located at the top of the elevator shaft and comprises a traction sheave 3 provided with cable grooves. The suspension cables 4 coming from the elevator cage 5 have been conducted to the traction sheave 3 through a gap between a diverting pulley 2 and the traction sheave 3. The suspension cables are wrapped around the traction sheave 3 in such manner that the angle of contact or wrap between the suspension cables and the traction sheave is, in practice, about 200° to 250°. The suspension cables are then directed obliquely downwardly and over the diverting pulley 2 back to the traction sheave 3 and wrapped once more around the traction sheave in such manner that the angle of contact or wrap between the suspension cables and the traction sheave 3 is again about 200° to 250°.

The suspension cables then continue further over a diverting pulley 7 to a counterweight 6. The path of the suspension cables has been indicated by arrows 8–12 in FIG. 1, the numerical sequence of these arrows indicating the mode in which the cables run over the traction sheave and the diverting pulleys 2 and 7. In the embodiment of FIG. 1, directions of the arrows 8–12 have been selected on the assumption that the elevator cage 5 is moving upwardly. With such an arrangement, the angle of contact or wrap between the traction sheave 3 and the suspension cables 4 is of the order of 400°–500° and may possibly be even more.

Figure 2:
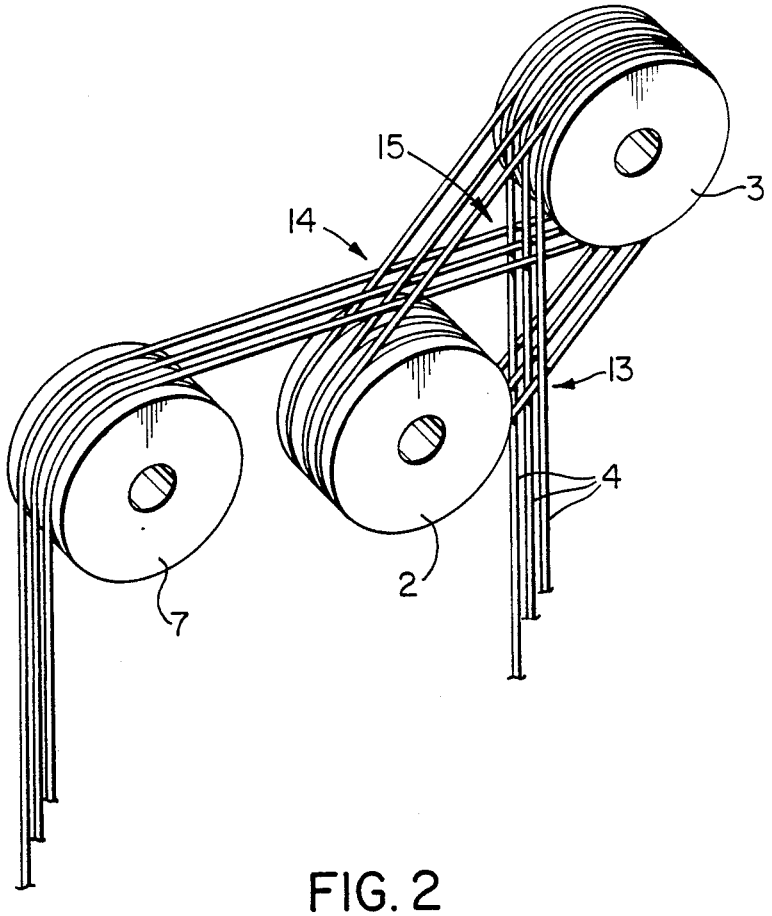
FIG. 2 illustrates, as viewed obliquely from above, an arrangement of diverting pulleys and a traction sheave and of cables passing over them which form parts of the elevator of FIG. 1.

As shown by FIG. 2, the suspension cables 4 are composed of three parallel cables. The number of cables may obviously be even greater. The cables have three crossing points 13, 14 and 15, at which points the cables are most advantageously disposed to run in intercalated fashion. In order to render such intercalation feasible the tractor sheave 3 has been appropriately inclined at an angle of 1° to 1.5° in the direction of the axis of the diverting pulley 2. similarly, the diverting pulley 2 has been inclined about the axis passing through the centres of traction sheave 3 and diverting pulley 2 (in FIG. 1 in the direction obliquely downward to the right). The diverting pulley 7 has also been tilted in order to obtain an appropriate cable angle. Likewise, the diverting pulley 7 has been displaced in its axial direction out of the plane defined by the traction sheave 3 and the diverting pulley 2, away from the viewer. It is to be understood that these tilts and axial shifts are in the nature of fine adjustment in the first place and that they can be accomplished in many other ways as well.

It will be apparent to those skilled in the art that the invention is not confined to the embodiment given by way of example in the foregoing and that it may be varied within the scope of appended claims.

I claim:

1. A traction sheave elevator comprising an elevator cage;

counterweight means for counterweighting said elevator cage;

suspension cable means extending between said counterweight means and said elevator cage for suspending said elevator cage;

traction sheave means for drivingly engaging said suspension cable means;

said traction sheave means having groove means for receiving said suspension cable means;

means for driving said traction sheave means to thereby displace said elevator cage; and at least two diverting pulley means associated with said traction sheave means for deflecting said suspension cable means;

said suspension cable means having first and second wraps around said traction sheave means and being wrapped, between said first and second wraps, about one of said diverting pulley means;

the angles of wrap of each of said first and second wraps being greater than 180°;

said suspension cable means comprising at least two suspension cables which are intercalated at locations .at which said suspension cable means cross themselves; and said traction sheave means being inclined towards said diverting pulley means and said diverting pulley means being inclined about an axis passing through the centers of said traction sheave and said diverting pulley means for achieving the intercalation of said suspension cables means.

2. A traction sheave elevator according to claim 1, wherein said first and second wraps have a total angle of wrap about said tractor sheave means of 400° to 540°.

3. A traction sheave elevator according to claim 1, wherein, in order to optimize the angle under which said suspension means meet said diverting pulley means, said diverting pulley means is displaced in its axial direction and turned towards the direction of said suspension means.

4. A traction sheave elevator according to claim 1 wherein said suspension cable means extends vertically between said traction sheave means and said two diverting pulley means to said first wrap and between said traction sheave means and said one of said diverting pulley means to the other of said diverting pulley means for said second wrap and thereby cross themselves at three separate locations.

5. A traction sheave elevator comprising an elevator cage;

counterweight means for counterweighting said elevator cage;

suspension cable means extending between said counterweight means and said elevator cage for suspending said elevator cage;

traction sheave means for drivingly engaging said suspension cable means;

said traction sheave means having groove means for receiving said suspension cable means;

means for driving said traction sheave means to thereby displace said elevator cage; and at least two diverting pulley means associated with said traction sheave means for deflecting said suspension cable means;

said suspension cable means having first and second wraps around said traction sheave means and being wrapped, between said first and second wraps, about one of said diverting pulley means;

the angles of wrap of each of said first and second wraps being greater than 180°; and said suspension cable means extending vertically between said traction sheave means and said two diverting pulley means to said first wrap and between said traction sheave means and said one of said diverting pulley means to the other of said diverting pulley means from said second wrap and thereby crossing themselves at three separate locations.

* * * * *